United States Patent [19]

O'Connor

[11] 4,230,356

[45] Oct. 28, 1980

[54] TILE-GROUT APPLICATOR

[76] Inventor: John D. O'Connor, 19720 NW. 5th Ave., Miami, Fla. 33169

[21] Appl. No.: 953,852

[22] Filed: Oct. 23, 1978

[51] Int. Cl.[3] ..... A47F 13/06

[52] U.S. Cl. ..... 294/19 R

[58] Field of Search ..... 294/19 R, 21, 22, 23, 294/1 R, 7, 43, 42; 15/144 R, 146 A, 146

[56] References Cited

U.S. PATENT DOCUMENTS

| | | | |
|---|---|---|---|
| 3,731,187 | 6/1973 | Pryor | 294/19 R |
| 4,127,296 | 11/1978 | Thomson | 294/19 R |

*Primary Examiner*—James B. Marbert

*Attorney, Agent, or Firm*—Barry L. Haley; Eugene F. Malin; Philip R. Wadsworth

[57] ABSTRACT

A tile-grout applicator for expeditiously applying grout to tile after it has been layed such as on a tile, marble and slate floor or the like, comprising a lightweight, rigid elongated blade mounting member, a somewhat flexible grout applicator blade removably connectable to said support member, and a handle connected at substantially a 35 degree angle to said blade support member such that when the support portion of the blade support member is parallel to the horizontal, the handle forms approximately a 35 degree angle. The support member includes a blade-retaining bar which projects at substantially a 90 degree angle to the support member along the midportion of the support member in a downward direction such that a groove disposed in the flexible applicator blade receives the protruding area on the support member to allow the resilient blade to become affixed to the support member. The blade has a tapered edge at substantially a 45 degree angle, the angular portion being disposed on the side of the applicator opposite the motion of the applicator. The length of the blade size may be varied to accommodate either cementitious grout or epoxy-like grout, a shorter blade being used for epoxy-like grout. In use, the tile is arranged in a series forming the desired pattern with spacing provided to allow for the desired grout joint size between adjacent tiles. Grout is then poured on the area to be grouted, then by use of the grout applicator, the grout is then troweled into the grout joints, at the same time it will clean approximately 80% of the grout off the surface of the tile.

3 Claims, 5 Drawing Figures

TILE-GROUT APPLICATOR

BACKGROUND OF THE INVENTION

This invention relates in general to a tool that is useful for applying grout to form grouting joints between adjacent tiles, and specifically to an applicator that makes tile grouting application more expeditious whether using cementitious or epoxy-like grout.

The applying of grout to a tile surface such as a tile floor has traditionally and conventionally been done almost by hand in that the tile man uses a hand trowel working on hands and knees or squatting in small areas by pouring the grout between the tiles and by hand troweling the excess grout to form the grouting joints while removing the excess to leave a smooth grouting joint between adjacent tiles. In recent years, the application of grouting has become extremely expensive because of such manual hand application of grout. Also, with the advent of resin-based grout forming epoxy grouting, hand contact and inhalation of resin vapors is realized to be hazardous and injurous to health.

The present invention overcomes and eliminates the necessity for applying grout by hand trowels while greatly increasing the speed of application without reducing the workmanship or structural integrity of the grouting joints by providing a tool that may be used in a standing position by the tile man and which quickly and expeditiously allows for the application of the grout.

BRIEF DESCRIPTION OF THE INVENTION

The applicator blade is made of a rubber or plastic-like material and a groove is sized to fit over a protruding portion on the T-shaped bar such that the blade is stretched about the bar portion that fits firmly and tightly on the bar. The tapered edge of the blade has a substantially formed 30–45 degree taper terminating in a point which contacts the tile and grout. The side of the blade closer to the operator of the device is substantially perpendicular to the rigid bar. The length of the blade, measured from end to end, may be varied to accommodate different types of grouting. For example, a shorter blade would be used for epoxy grout or any resin based grout (for greater force application) whereas a longer blade may be used for cementitious type grout.

In operation the operator would grasp the handle of the device and after the grouting has been poured over the tiles and in the joints, would draw of from the upper surfaces of the tiles and joints excess grouting using the pulling force exerted on the blade. The blade thus acts to contain and draw the excess grouting from the upper surface of the tile and the joints, at the same time filling the joints. The applicant has found that through the use of the tool in conjunction with the pulling motion of the operator, applicant's device provides for smooth grouting of joints and removal of excess grout from both the upper portion of the grouting joint and the tile surface itself. A raised barrier extending above the support bar prevents overflow of grout during application.

It is an object of this invention to provide an improved tool for expeditiously applying grout for tiling floors and the like.

It is another object of this invention to provide a grouting tool which greatly reduces the labor time involved in the pouring and forming of grouting joints between pieces of tile whether for cementitious or epoxy resin-type grouting.

And yet, still another object of this invention is to allow a grouting tool that does not require the operator to perform a grouting application operation essentially on his hands and knees, allowing it to be done from a standing position.

In accordance with these and other objects which will be apparent hereinafter, the instant invention will now be described with particular reference to the accompanying drawings.

PREFERRED EMBODIMENT OF THE INVENTION

Figure 1:
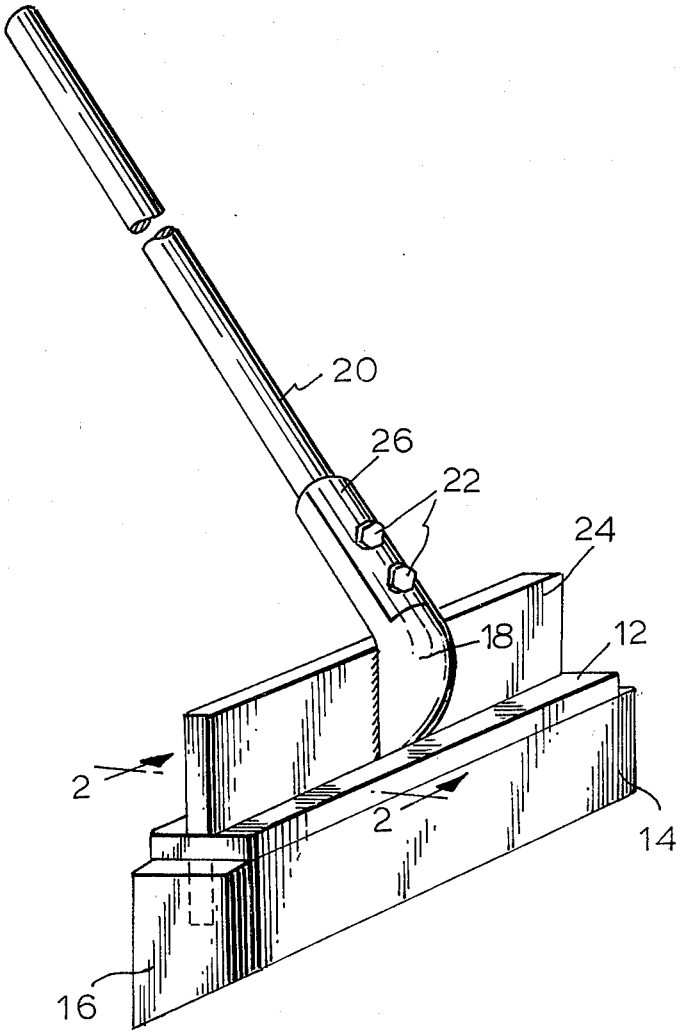
FIG. 1 shows a perspective view of the present invention.

Referring now to the drawings and specifically FIG. 1, the instant invention is shown comprised of a rigid blade support bar 12 having a flexible blade 14 attached thereto along a groove 16. Integrally formed along the upper surface of the bar 12 is a grout barrier 24, a rigid handle receptacle 18, and handle cap 26 having an elongated handle 20 attached thereto by a pair of bolts 22 and nuts 28. The grout barrier 24 prevents an overflow of grout during the grouting operation.

Figure 2:
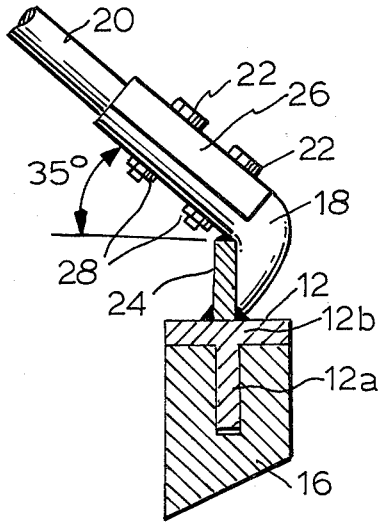
FIG. 2 shows the side elevational view partially in cross-section of the instant invention along line 2—2 of FIG. 1.

Referring now to FIG. 2, the lower portion of the support bar 12 has a protruding flange **12*a* which is substantially perpendicular to the upper bar portion 12*b*. The angle formed between the flange 12*a* and the lower surface of the blade is preferably between 30 and 45 degrees. Also, the handle forms approximately a 35 degree angle with the plane through support bar surface 12*b*** on the rigid bar. The angles are important to provide the proper applicator surface edge of the blade in operation.

Figure 3:
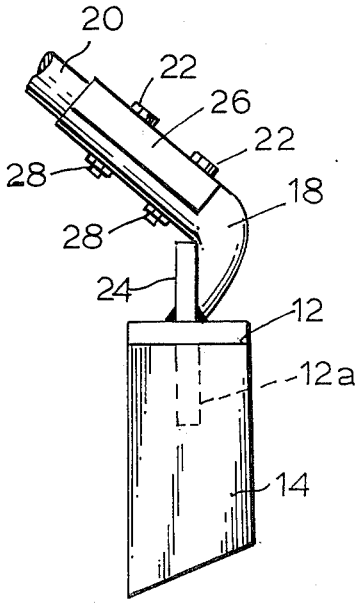
FIG. 3 shows a side elevational view of the instant invention.

FIG. 3 shows a side view of the present invention.

Figure 4:
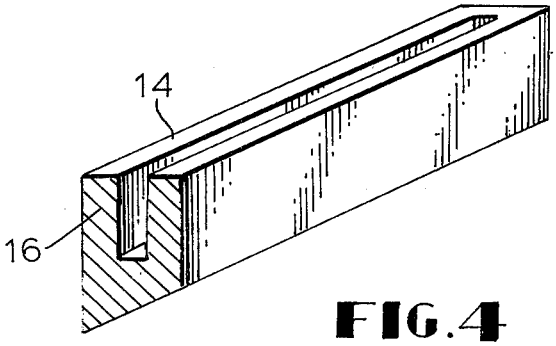
FIG. 4 shows a perspective view of a blade utilized with the instant invention.
Figure 5:
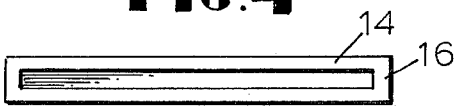
FIG. 5 shows a top plan view of the blade shown in FIG. 4.

FIG. 4 shows the blade 14 including a groove 16 which allows the blade 14 to be readily attached to the support bar flange **12*a*** without requiring additional connectors such as nuts and bolts and the like. The longitudinal length of the blade may be varied for different types of grout. For example, a short blade would be used with epoxy-resin grout to allow for a greater application of force. The longer blade would be employed with cementitious grout.

In use, the operator will grasp the handle in a standing position and draw the blade across the tile and grouting joint surface toward the operator such that the blade side having the longer vertical height of the blade is closer to the operator.

The instant invention has been shown and described herein in what is considered to be the most practical and preferred embodiment. It is recognized, however, the departures may be made therefrom within the scope of the invention and that obvious modifications will occur to a person skilled in the art.

What I claim is:

1. A tool useful for applying grouting, comprising:

a rigid supporting bar having an upper surface and a lower surface, said bar including an elongated flange disposed outwardly and substantially perpendicular to the lower surface;

a handle;

means connected to the upper surface of said support bar for connecting said handle to said support bar; and p1 a flexible blade, said blade including an upper surface and a lower surface, said blade having a groove disposed in said upper surface, said groove length being substantially the length of said support bar flanged such that said flange may fit in said groove when said blade is stretched to firmly hold said blade to said support bar, said lower surface of said blade being tapered in shape to provide a blade angle of from 30 degrees to 45 degrees.

2. A tool as in claim 1, including:

said handle being attached to said rigid support bar forming substantially a 35 degree angle relative to a plane passing through the upper surface of said support bar.

3. A tool as in claim 2, wherein:

said shorter height on said blade being disposed on a side opposite the direction of the handle.

* * * * *